US007197153B2

(12) United States Patent
Gleissner

(10) Patent No.: US 7,197,153 B2
(45) Date of Patent: Mar. 27, 2007

(54) MICROPHONE STAND

(75) Inventor: Achim Gleissner, Barienrode (DE)

(73) Assignee: Sennheiser electronic GmbH & Co. KG, Wedemark (DE)

( * ) Notice: Subject to any disclaimer, the term of this patent is extended or adjusted under 35 U.S.C. 154(b) by 60 days.

(21) Appl. No.: 10/793,127

(22) Filed: Mar. 4, 2004

(65) Prior Publication Data

US 2004/0175013 A1 Sep. 9, 2004

(30) Foreign Application Priority Data

Mar. 4, 2003 (DE) ..... 103 09 568

(51) Int. Cl.
*H04R 25/00* (2006.01)

(52) U.S. Cl. ..... 381/363; 381/361; 381/362

(58) Field of Classification Search ..... 381/369, 381/355, 359, 361, 366, 363, 362, 368, 360, 381/365, 367, 390, 91, 92, 111, 115, 118, 381/122; 455/128, 95, 117; 248/559, 566, 248/638, 121, 188.9
See application file for complete search history.

(56) References Cited

U.S. PATENT DOCUMENTS

| | | | | |
|---|---|---|---|---|
| 2,717,932 | A | 9/1955 | Rackham et al. | |
| 3,718,862 | A | 2/1973 | Norris | |
| 4,396,800 | A * | 8/1983 | McDonnell et al. | 381/122 |
| 4,831,656 | A | 5/1989 | Southern et al. | |
| 5,881,156 | A | 3/1999 | Treni et al. | |
| 6,548,987 | B1 | 4/2003 | Oster et al. | |
| 6,590,989 | B2 * | 7/2003 | Chen | 381/363 |
| 6,711,272 | B2 * | 3/2004 | Rodgers | 381/363 |
| 2001/0034214 | A1 * | 10/2001 | Koike | 455/95 |

FOREIGN PATENT DOCUMENTS

| | | |
|---|---|---|
| DE | 195 35 198 | 5/1996 |
| DE | 200 06 539 | 11/2000 |

* cited by examiner

*Primary Examiner*—Huyen Le
(74) *Attorney, Agent, or Firm*—Reed Smith LLP

(57) ABSTRACT

The invention is based on the idea of separating the microphone unit and the wireless transmitter device from wireless microphones and to connect the wireless transmitter device to a microphone stand. Accordingly, a microphone stand comprises a first XLR audio connection for accommodating a microphone and also a second XLR audio connection for accommodating a wireless transmitter device, the first and second audio connections being electrically connected.

5 Claims, 3 Drawing Sheets

MICROPHONE STAND

CROSS-REFERENCE TO RELATED APPLICATIONS

This application claims priority of German Application No. 103 09 568.3, filed Mar. 4, 2003, the complete disclosure of which is hereby incorporated by reference.

BACKGROUND OF THE INVENTION

1. Field of the Invention

The invention relates to a microphone stand and also a microphone system having a microphone, a transmitter device and a microphone stand.

2. Description of the Related Art

Stands which serve to accommodate microphones have been sufficiently well known for a long time. With such microphones, wire-bound or wireless microphones are fixed to the stand by means of a corresponding clamping device.

Microphone stands are used in particular so that the microphone does not have to be held in the user's hands, but instead the microphone is fixed resting in the stand so that singers or the like, for example, have both hands free.

In other microphone stands the microphones are fixed to the stand by means of a plug-in connection, such as, for example, an XLR audio connection. In this case a cable is frequently passed into the interior of the stand, which takes place both for aesthetic and also for practical reasons. With all wire-bound microphones a cable connection, preferably a detachable one, has to be provided, which connects the microphone to the devices in the following audio processing unit, such as, for example, a mixing console or a recording device.

The provision of cable connections to the following audio processing unit for each wire-bound microphone proves to be very expensive in some cases. Therefore wireless microphones are often used, because the cable connection, as is known, is not provided in their case.

Wireless microphones as a rule have a microphone unit and also a wireless transmission unit, in which case a wireless receive unit especially matched to the microphone has to be provided for each wireless microphone. The adaptation between the wireless microphone and the wireless receive unit is very important in this case, specifically in particular when a plurality of wireless microphones are to be operated in a limited space, so that interference can be avoided between the different microphones/transmission units and receive units. However, this proves to be disadvantageous as consequently both the wireless microphones and also the receive units cannot be universally used, but only in pairs in each case.

OBJECT AND SUMMARY OF THE INVENTION

Consequently the primary object of the invention is to provide an audio processing environment which guarantees a universal use of microphones and receiver devices.

In accordance with the invention, a microphone stand comprises a first XLR audio connection and a second XLR audio connection for accommodating a wireless transmitter device, wherein the first and second audio connection are electrically connected.

Further, in accordance with the invention, a microphone system comprises a microphone, a wireless transmitter device and a microphone stand as set forth in the preceding paragraph.

The invention is therefore based on the idea of separating the microphone unit and the wireless transmitter device from wireless microphones and connecting the wireless transmitter device to a microphone stand.

Accordingly, a microphone stand comprises a first XLR audio connection to accommodate a microphone and also a second XLR audio connection to accommodate a wireless transmitter device, the first and the second audio connections being electrically connected.

By using the first XLR audio connection, a microphone can consequently be connected to the microphone stand and also be exchanged when necessary. A wireless transmitter device can also be connected to the microphone stand and be exchanged where appropriate by means of the second XLR audio connection.

Consequently all current microphones having an XLR audio connection and all wireless transmitter devices which have an XLR audio connection can be connected to the microphone stand.

Since only the wireless transmitter device connected to the microphone stand and a corresponding receive device have to be matched to one another, in this case the microphones used can be universally used provided that they have an appropriate plug-in connection.

In accordance with one embodiment of the invention, the microphone stand comprises a wireless transmitter device so that the microphone stand and the wireless transmitter device are connected to one another in such a manner that the wireless transmitter device can be expanded without any problems for maintenance or repair, since the wireless transmitter device is connected to the microphone stand by means of the second plug-in connection.

In another embodiment of the invention, the microphone stand comprises a cover for the wireless transmitter device. The cover of the wireless transmitter device in this case serves both to protect it and also for aesthetic reasons.

In a preferred embodiment of the invention, the electrical connection between the first and the second plug-in connection is laid inside the stand. This has the particular advantage that the electrical connection is protected.

The invention also relates to a microphone system consisting of a microphone, a transmitter device and a microphone stand in accordance with the above mentioned embodiments of the invention.

BRIEF DESCRIPTION OF THE DRAWINGS

The invention is described in detail below with reference to the figures, the figures showing in pictorial or partial pictorial views.

DESCRIPTION OF THE PREFERRED EMBODIMENTS

Figure 1:
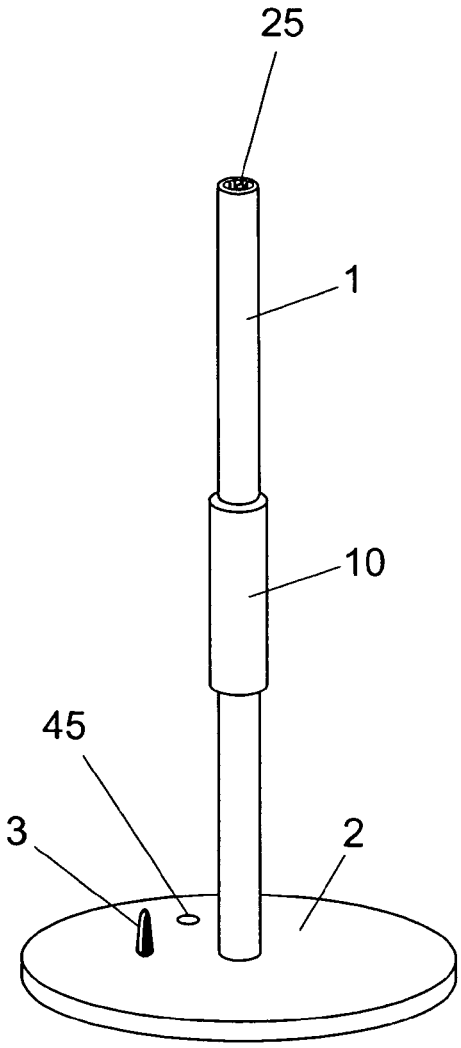
FIG. 1, a microphone stand according to a first exemplified embodiment.

FIG. 1 shows a microphone stand in accordance with a first exemplified embodiment of the invention. The microphone stand 1 in this case comprises a base 2 with an integrated transmitter unit 45, an antenna for the radio connection 3 and also a height-adjustable stand tube 10. At the upper end of the stand tube 10 is provided an XLR audio connection 25, to which a microphone can be connected with an XLR audio connection. In this exemplified embodiment, the wireless transmitter device 45 is integrated in the base of the microphone stand. The transmitter device 45 is preferably connected to the base 2 by means of a detachable plug-in connection, so that the transmitter device 45 can be expanded for maintenance and repair purposes. The transmitter unit 45 is connected to the antenna 3, by means of which the transmitter device 45 communicates with a corresponding wireless receive device.

Figure 2:
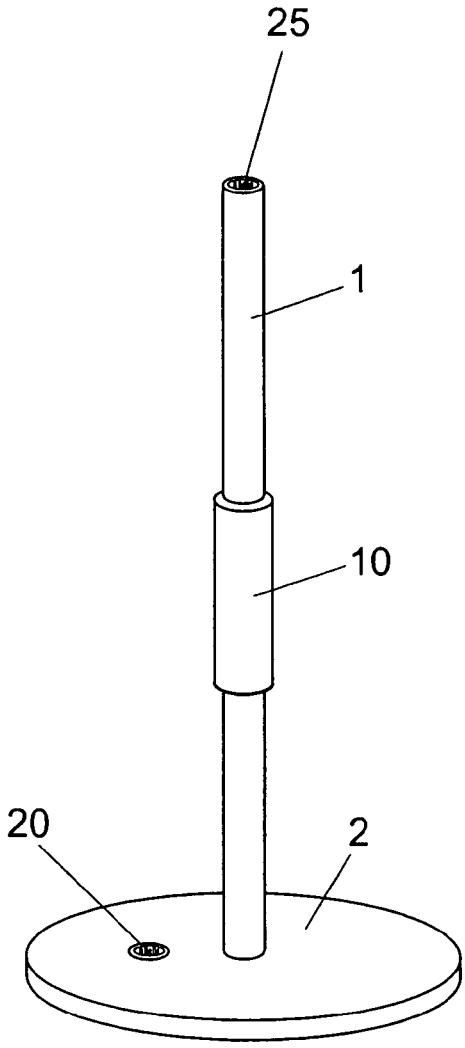
FIG. 2, a microphone stand according to a second exemplified embodiment.

FIG. 2 shows a microphone stand according to a second exemplified embodiment. The stand according to the second exemplified embodiment corresponds essentially to the first exemplified embodiment, with, however, just an XLR audio connection 20 being provided in the base 2 of the microphone stand 1, i.e. the base 2 does not comprise an integrated transmitting device. A wireless transmitter device having an XLR audio connection can then be placed onto the plug 20, so that this wireless transmitter device then communicates with the corresponding wireless receiver device.

Figure 3:
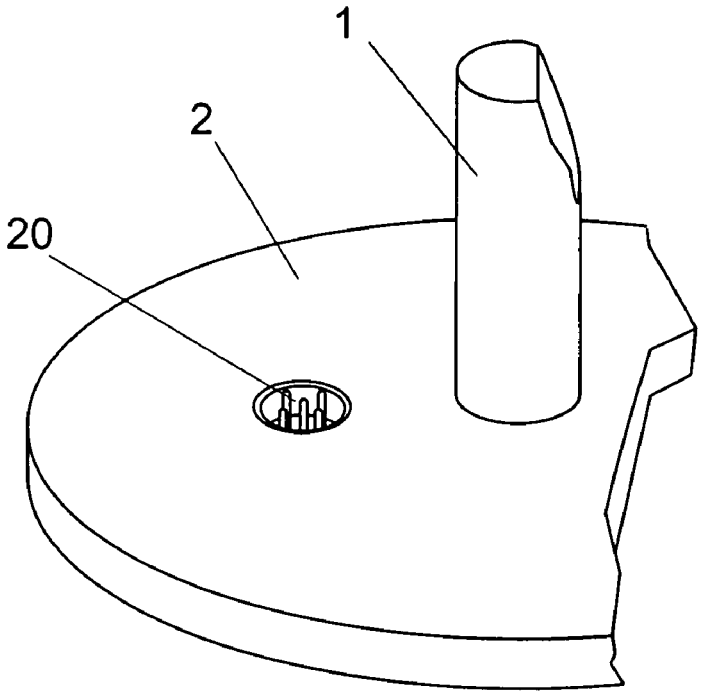
FIG. 3, a base of a microphone stand of FIG. 2.

FIG. 3 shows a base of a microphone stand according to the second exemplified embodiment. Here the XLR audio connection 20 can be seen in greater detail. It is preferably an XLR plug which is inserted into the base 2 of the microphone stand 1.

Figure 4:
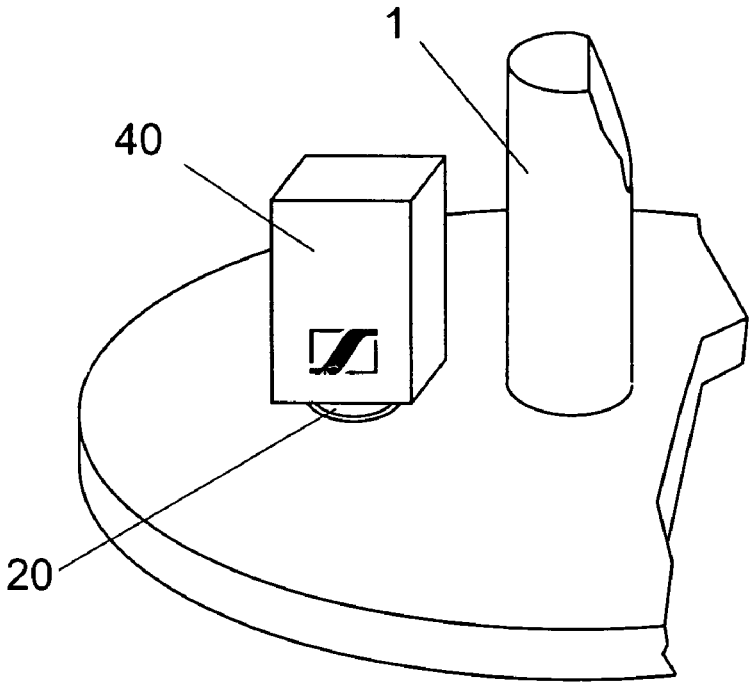
FIG. 4, a base of a microphone stand of FIG. 2 or 3.

FIG. 4 shows a base 2 of a microphone stand 1, the base comprising an embedded XLR plug 20. A wireless transmitter device 40 with an XLR audio connection is in this case fixed in the embedded XLR plug 20 Of the base 2. This wireless transmitter device 40 may be commercially available wireless transmitter devices having an XLR audio connection.

Figure 5:
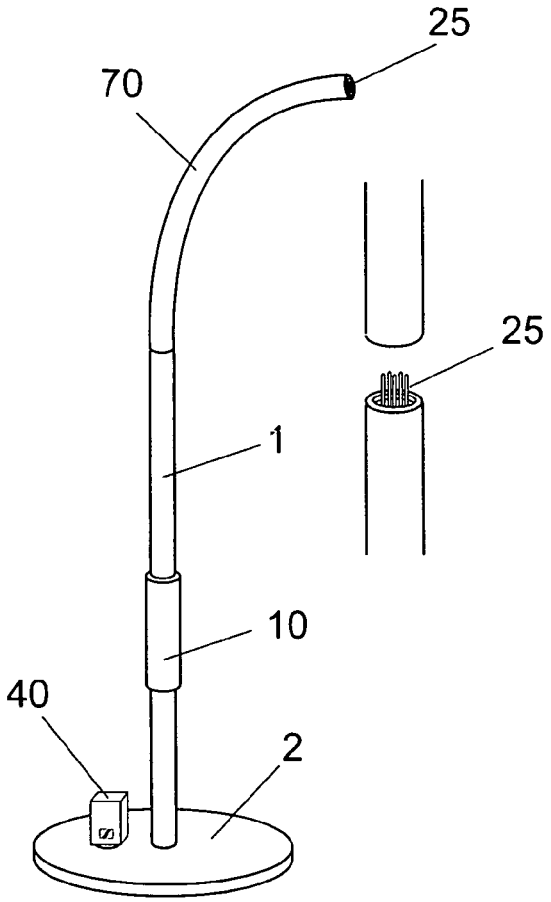
FIG. 5, a microphone stand according to a third exemplified embodiment.

FIG. 5 shows a microphone stand according to a third exemplified embodiment of the invention. This stand essentially corresponds to the microphone stand according to the second exemplified embodiment of the invention, i.e. in its base 2 an XLR audio connection 20 is provided with an XLR audio connection 40 to accommodate a wireless transmitter device. At the top end of the stand a gooseneck 70 is provided, which in turn comprises an XLR audio connection 25 to accommodate a microphone at its free end.

Figure 6:
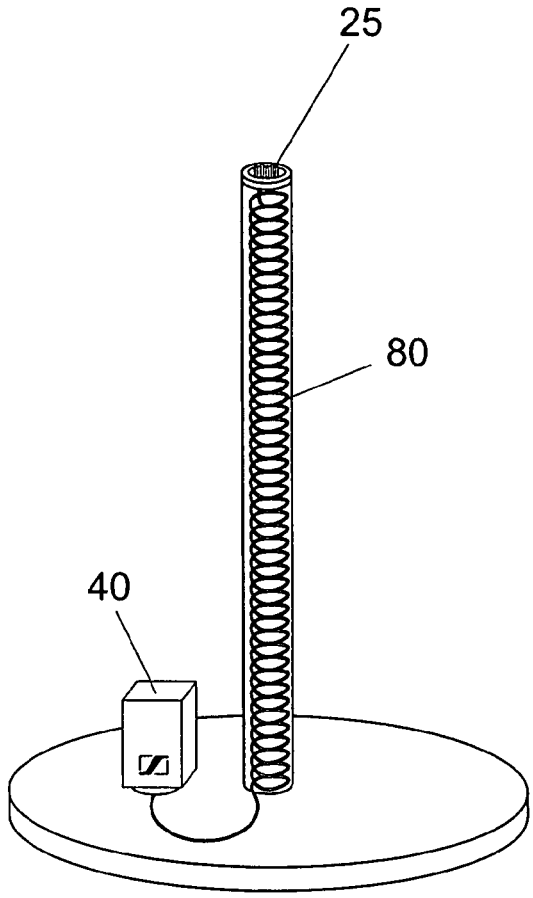
FIG. 6, a microphone stand according to another exemplified embodiment.

FIG. 6 shows a microphone stand according to the second or third exemplified embodiment. The electrical connection between the XLR audio connection 25 and the slip-on wireless transmitter device 40 is designed inside the stand tube. Thus a concealed cable run is achieved, which serves both to protect this cable connection 80 and also aesthetic purposes.

Figure 7:
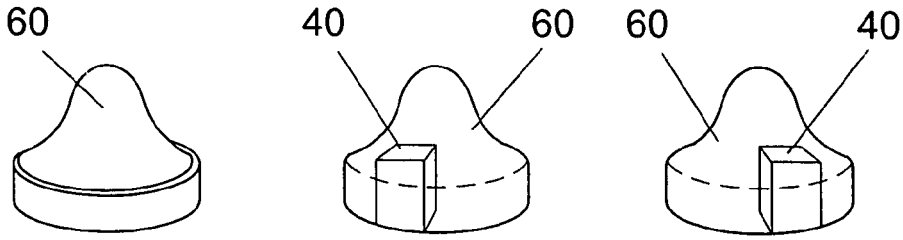
FIG. 7, covers for a wireless transmitter device.

FIG. 7 shows masking devices 60, which are intended to serve as covers for the wireless transmission device 40. These covers are used to protect the wireless transmission device 40, which in accordance with the second or third exemplified embodiment is placed on the XLR audio connection 20. The embodiment of the masking device may also take place for aesthetic reasons.

Although only XLR audio connections have been described in the exemplified embodiments, of course other plug-in connections can also be used. The receive device required for wireless communication can be constructed by commercially available wireless receive devices.

The following audio processing device is not explicitly shown here, but reference can be made to all commercially available products.

While the foregoing description and drawings represent the present invention, it will be obvious to those killed in the art that various changes may be made therein without departing from the true spirit and scope of the present invention.

What is claimed is:

1. A microphone stand comprising:

a base of the microphone stand comprising a height adjustable stand tube;

a first XLR audio connection provided at the upper end of the height adjustable stand tube;

a detachable microphone connectable to the first XLR audio connection; and wherein the base of the microphone stand includes a second XLR audio connection for accommodating a wireless transmitter device;

wherein the first and second audio connections are electrically connected.

2. The microphone stand according to claim 1, wherein the wireless transmitter device, is connected in an electrically detachable manner to the microphone stand via the second audio connection.

3. The microphone stand according to claim 1, having a cover for the wireless transmitter device.

4. The microphone stand according to claim 1, wherein the electrical connection between the first and the second audio connections is laid inside the height adjustable stand tube.

5. A microphone system comprising:

the microphone;

the wireless transmitter device; and the microphone stand according to claim 1.

* * * * *

UNITED STATES PATENT AND TRADEMARK OFFICE

CERTIFICATE OF CORRECTION

PATENT NO. : 7,197,153 B2
APPLICATION NO. : 10/793127
DATED : March 27, 2007
INVENTOR(S) : Achim Gleissner It is certified that error appears in the above-identified patent and that said Letters Patent is hereby corrected as shown below:

IN THE SPECIFICATION:

| | | | | |
|---|---|---|---|---|
| Column 3, | line 33, | after 20 | change | "Of" |
| | | | to | --of-- |

IN THE CLAIMS:

Column 4, line 37 after device delete the comma ","

Signed and Sealed this

Eighteenth Day of September, 2007

JON W. DUDAS
*Director of the United States Patent and Trademark Office*